US010611565B2

(12) United States Patent
Housand

(10) Patent No.: US 10,611,565 B2
(45) Date of Patent: Apr. 7, 2020

(54) REFUSE CONTAINER PROTECTIVE LINER AND METHOD OF USING THE SAME

(71) Applicant: Christopher W. Housand, Chesapeake, VA (US)

(72) Inventor: Christopher W. Housand, Chesapeake, VA (US)

( * ) Notice: Subject to any disclaimer, the term of this patent is extended or adjusted under 35 U.S.C. 154(b) by 29 days.

(21) Appl. No.: 15/674,665

(22) Filed: Aug. 11, 2017

(65) Prior Publication Data

US 2019/0047785 A1 Feb. 14, 2019

(51) Int. Cl.
*B65F 1/08* (2006.01)
*B65F 1/14* (2006.01)

(52) U.S. Cl.
CPC ..... *B65F 1/08* (2013.01); *B65F 1/141* (2013.01)

(58) Field of Classification Search
USPC ..... 229/117.28; 220/23.9, 23.91, 908–911, 220/574.3, 495.01–495.11
See application file for complete search history.

(56) References Cited

U.S. PATENT DOCUMENTS 3,157,902 A * 11/1964 Hardwick ..... B44D 3/126 15/257.06
4,765,123 A * 8/1988 Caldwell ..... B44D 3/126 220/570
4,978,028 A * 12/1990 George ..... A61B 50/36 206/366
5,358,138 A * 10/1994 Karwoski ..... B65F 1/06 108/26
D569,567 S * 5/2008 Kohn ..... D32/53.1
8,342,356 B2 * 1/2013 Busch ..... B65F 1/068 206/366
8,720,686 B1 * 5/2014 Shuman ..... B65F 1/14 206/459.1
8,740,009 B2 * 6/2014 Otsuka ..... F17C 13/06 220/588
2009/0050632 A1 * 2/2009 Martin ..... B44D 3/126 220/570
2013/0299436 A1 * 11/2013 Krusoe ..... B44D 3/12 210/767
2015/0114968 A1 * 4/2015 Jolls ..... B65D 31/14 220/495.02
2018/0290813 A1 * 10/2018 Waltermire ..... B65D 81/3813

* cited by examiner

*Primary Examiner* — Kareen K Thomas
(74) *Attorney, Agent, or Firm* — Law Office of Jerry Joseph, PLC; Jerry K. Joseph

(57) ABSTRACT

A protective liner insert apparatus for use with a refuse container, the insert apparatus including a planar base member having a first surface, an opposing second surface, and a plurality of sides, a first side wall support member extending from a first side of the planar base member, a second side wall support member extending from a second side of the planar base member, and a third side wall support member extending from a third side of the planar base member, wherein the first, second, and third side wall support members are each angled with respect to the planar base member to protect inner corners and edges of the refuse container from impact.

5 Claims, 18 Drawing Sheets

REFUSE CONTAINER PROTECTIVE LINER AND METHOD OF USING THE SAME

FIELD OF INVENTION

The present general inventive concept relates to a liner, and more particularly, to a protective liner insert that is used to repair damaged or worn out flooring of conventional refuse containers. The protective liner includes sidewall support members which are specifically designed to deflect impact points away from inner edges and corners of the refuse containers.

BACKGROUND

Refuse or waste containers are used by many residential and commercial buildings to temporarily store waste. Conventional refuse containers are formed in various shapes and sizes, such as rectangular or circular, in order to accommodate various types and volumes of waste. However, although these conventional refuse containers are manufactured from metal, the flooring, inner edges and corners of the containers become damaged over a period of time due to use. In addition, the inner edges and corners of the refuse containers are more often damaged as a result of greater frequency of impacts from items thrown into the containers.

As a result, flat metal patches have been used to repair the damaged flooring of the containers. However, this solution fails to adequately protect the inner edges or corners of the containers from impact, thereby requiring continuous and costly repairs.

Therefore, what is desired is a protective insert liner that protects the flooring as well as the inner edges and corners of conventional refuse containers. Also, what is desired is a protective insert liner that may be easily stored, transported, and installed onto conventional refuse containers.

BRIEF SUMMARY OF THE INVENTION

The present general inventive concept provides a protective liner, and more particularly, to a protective liner insert used to repair and protect damaged or worn out flooring, inner edges and corners of conventional refuse containers from further damage.

The present general inventive concept further provides a protective liner insert that includes sidewall support members which are specifically designed to deflect impact points away from inner flooring, edges and corners of the refuse containers.

The foregoing and/or other aspects of the present general inventive concept may be achieved by providing a protective liner insert apparatus for use with a refuse container, the insert apparatus including a planar base member having a first surface, an opposing second surface, and a plurality of sides, a first side wall support member extending from a first side of the planar base member, a second side wall support member extending from a second side of the planar base member, and a third side wall support member extending from a third side of the planar base member, wherein the first, second, and third side wall support members are each angled with respect to the planar base member to protect inner corners and edges of the refuse container from impact.

The first, second, and third side wall support members extend from the planar base member nay be constructed from a metal.

The planar base member may be constructed from a metal material.

The planar base member may have a thickness of between 0.125 to 1.00 inches. However, the present general inventive concept is not limited thereto.

The wheels attached to second surface of the planar base member to allow for easy transport.

The foregoing and/or other aspects of the present general inventive concept may also be achieved by providing a foldable protective liner insert apparatus for use with a refuse container, the foldable protective insert apparatus including a pair of planar base members each having a first surface, an opposing second surface, and a plurality of sides, a hinge member coupled between each planar base members, a first side wall support member extending from a first side of the base member, a second side wall support member extending from a second side of the base member, and a third side wall support member extending from a third side of the base member, wherein the side wall support members are each angled with respect to the base member to protect inner corners and edges of the refuse container from impact.

The planar base member may be constructed from a metal or metallic material. However, the present general inventive concept is not limited thereto.

The planar base member may have a thickness of between 0.125 to 1.00 inches. However, the present general inventive concept is not limited thereto.

The foldable protective liner insert may further include wheels attached to second surface of the planar base member to allow for easy transport and installation onto the conventional refuse container.

The foldable protective liner insert may further include a hinge disposed along a center of the planar base member to allow the base member to fold for easy transport and storage.

Additional aspects of the present general inventive concept will be set forth in part in the description which follows and, in part, will be obvious from the description, or may be learned by practice of the general inventive concept.

BRIEF DESCRIPTION OF THE FIGURES

These and/or other aspects of the present general inventive concept will become apparent and more readily appreciated from the following description of the various embodiments, taken in conjunction with the accompanying drawings of which.

DETAILED DESCRIPTION OF THE PREFERRED EMBODIMENTS

Reference will now be made to the example embodiments of the present general inventive concept, examples of which are illustrated in the accompanying drawings and illustrations. The example embodiments are described herein in order to explain the present general inventive concept by referring to the figures.

The present general inventive concept provides a refuse container liner insert which is designed and/or configured to cost effectively and easily repair conventional refuse containers.

The present general inventive concept also provides a refuse container liner insert that is designed to protect the flooring as well as the inner edges and corners of conventional refuse containers.

The present general inventive concept also provides a refuse container liner insert that may be easily folded for storage and may include wheels for ease of folding, unfolding, and transportation. That is, the wheels may assist in installing onto conventional refuse containers, and un-folding for installation onto the refuse container.

The present general inventive concept also provides a refuse container liner insert that is easy to install within various commercially available refuse containers.

The present general inventive concept also provides a refuse container liner insert which is designed and/or configured to divert and/or deflect refuse from impacting the inner edges, corners, and flooring of conventional refuse containers.

Figure 1:
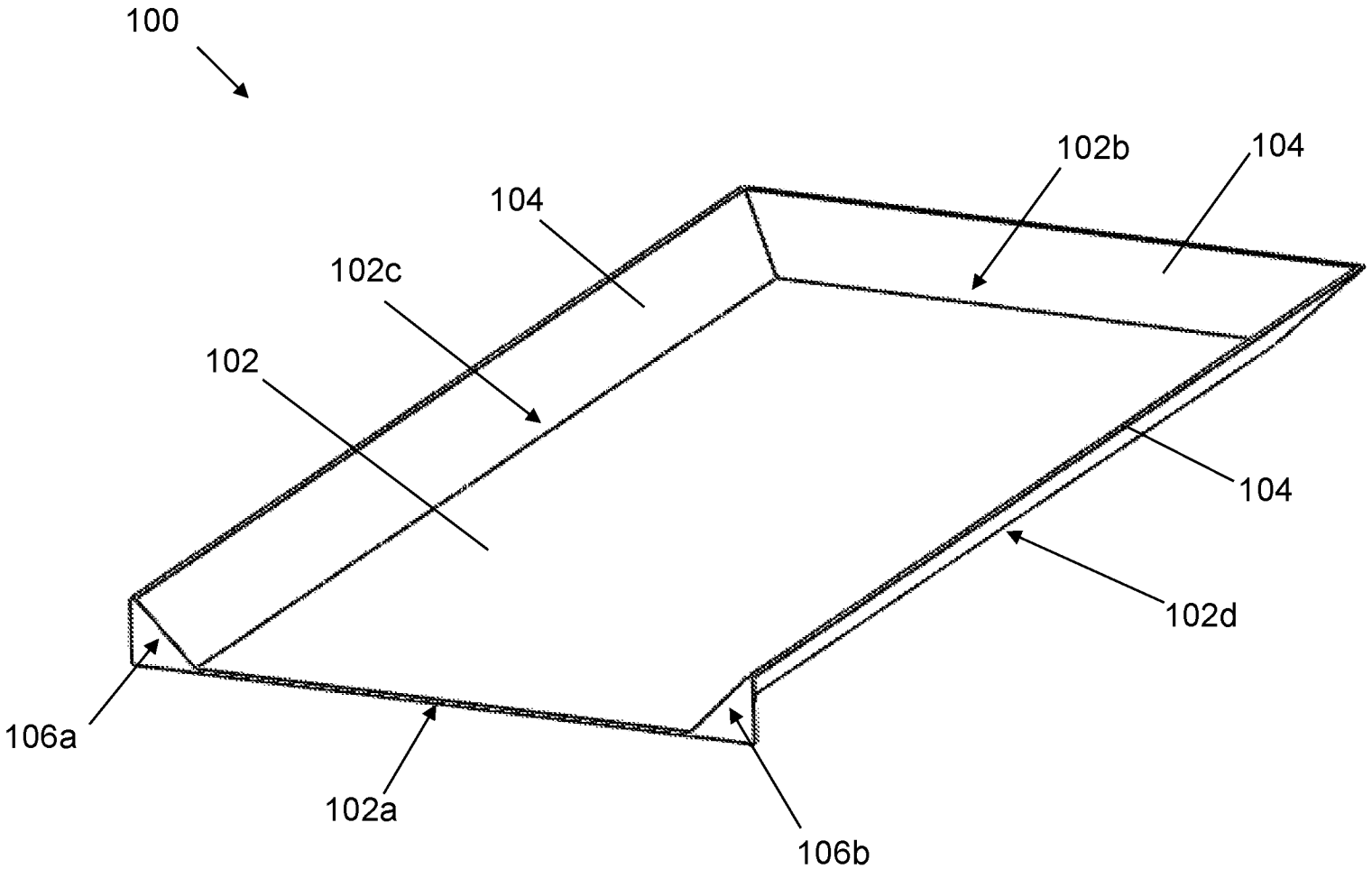
FIG. 1 is a front perspective view of a refuse container protective liner insert according to an example embodiment of the present general inventive concept.
Figure 2:
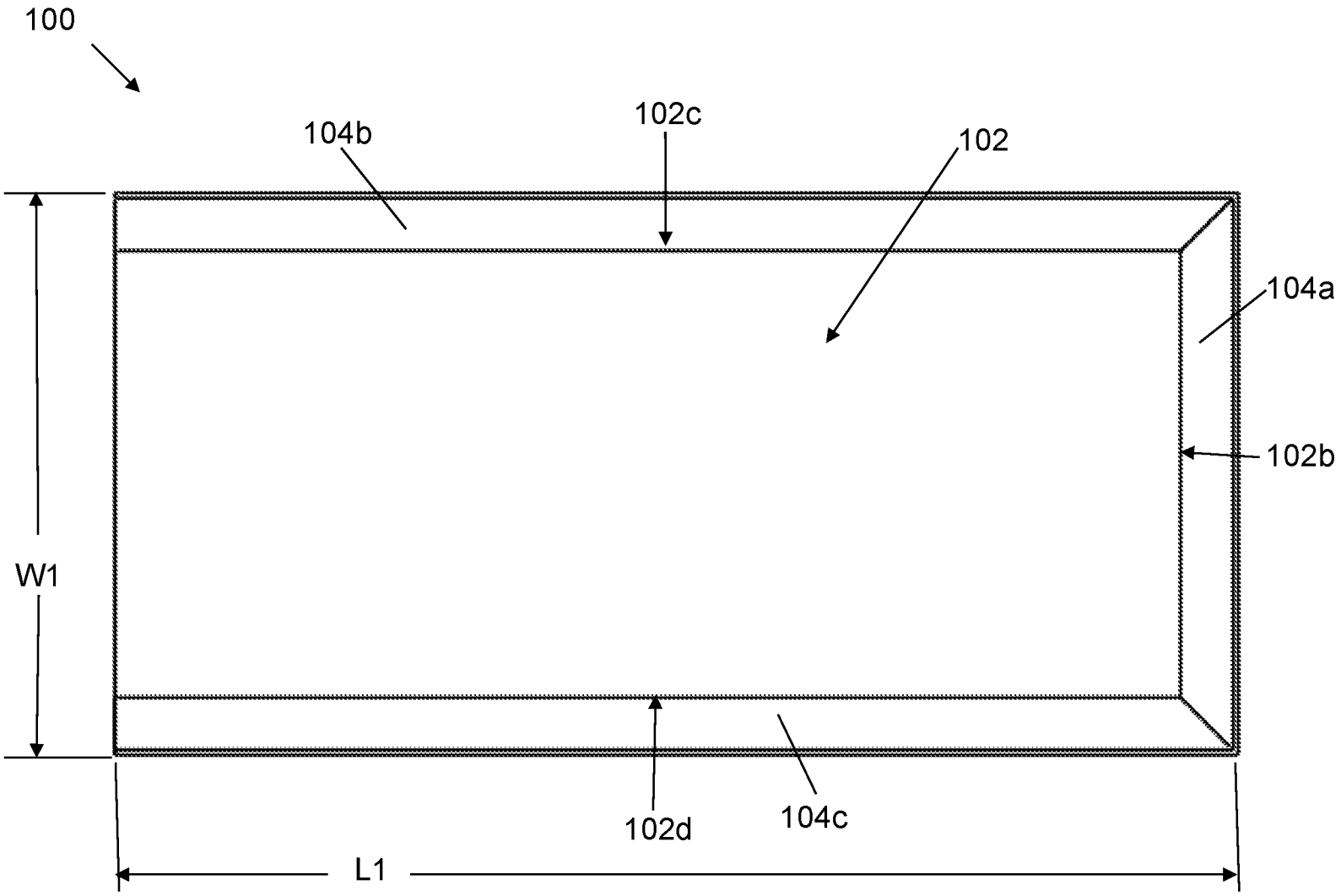
FIG. 2 is a top plan view of the protective liner insert illustrated in FIG. 1.
Figure 3:
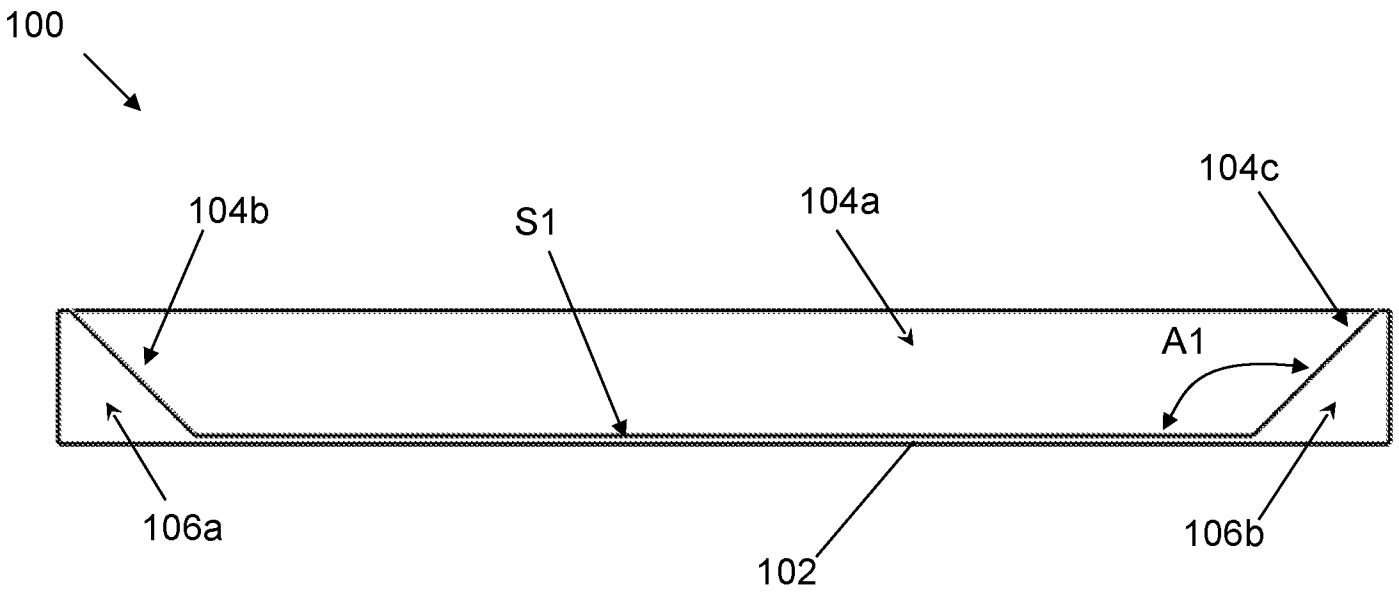
FIG. 3 is a front view of the protective liner insert illustrated in FIG. 1.

FIG. 1 is a front perspective view of a refuse container protective liner insert 100 according to an example embodiment of the present general inventive concept. FIG. 2 is a top plan view of the protective liner insert 100 illustrated in FIG. 1 and FIG. 3 is a front view of the protective liner insert 100 illustrated in FIG. 1.

Referring now to FIG. 1, the refuse container protective liner insert 100 according to the present embodiment includes a planar (i.e., flat) base member 102 having a first side 102*a* (i.e., a proximal end), an opposing second side 102*b* (i.e., a distal end), a third side 102*c* (i.e., a left side), and an opposing fourth side 102*d* (i.e., a right side). The protective liner insert 100 is sized and shaped so as to fit within conventional refuse containers 10. That is, the protective liner insert 100 includes side wall support members 104 which extend from the base member 102 and which are sized and shaped to have an overall width and length that corresponds a width and length of conventional refuse containers 10. However, the present general inventive concept is not limited thereto. That is, in alternative example embodiments, the protective liner insert 100 may be manufactured to correspond to a wide variety of a shapes and sizes, as desired. The protective liner insert 100 may designed to protect inner flooring 10*a*, edges 10*b*, and corners 10*c* of the conventional refuse container 10.

In the present embodiment, the protective liner insert 100 may be formed in a rectangular shape and includes a plurality of angled side wall support members 104 which extend from the sides of the planar base member 102. The plurality of side wall support members 104 are specifically designed to protect the inner flooring 10*a*, the inner edges 10*b* and corners 10*c* of the refuse container 10 from impact from items thrown into the refuse container 10 (see FIG. 6). The side wall support members 104 are further designed to protect and strengthen walls 12 of the refuse container 10 when the protective liner insert 100 is installed and fixed to the refuse container 10.

In exemplary embodiments, the protective liner insert 100 may be fixed to the refuse container 10 by various mechanical fastening means including welding and nuts and bolts. However, the present general inventive concept is not limited thereto. That is, in alternative exemplary embodiments, the protective liner insert 100 may be detachably fixed to the refuse container 10 using high strength magnets or the like.

Referring now to FIG. 1, in the present example embodiment, the protective liner insert 100 may further include a pair of end support members 106*a*, 106*b* which are coupled to the base member 102 and ends of the side wall support members 104, in order to secure the side wall support members 104 to the base member 102 at a predetermined angle A1. That is, a first end-support member 106*a* is coupled to an end of the side wall support member 104 and to the first end 102*a* of the base member 102 to fix the side wall support member 104 at the predetermined angle A1. Similarly, a second end-support member 106*b* is coupled to an end of another side wall support member 104 and to the first end 102*a* of the base member 102 to fix the other side wall support member 104 at the predetermined angle A1. In exemplary embodiments, the predetermined angle A1 may range between about 10 degrees to about 60 degrees. In a preferred embodiment, the predetermined angle A1 may be about 30 to about 50 degrees, and more preferably 45 degrees. However, the present general inventive concept is not limited thereto.

In the present example embodiment, the pair of end support members 106*a*, 106*b* may help maintain the wall support members 104 at the predetermined angle A1 (i.e., 45 degrees) and strengthen and protect the inner edges 10*b* and corners 10*c* of the refuse container 10 from further damage. However, the present general inventive concept is not limited thereto.

The end-support members 106*a*, 106*b* may be formed in a triangular shape. However, the present general inventive concept is not limited thereto. That is, the end support members 106*a*, 106*b* may be formed in various shapes and sizes in order to secure the sidewall support members 104 to the walls 12 of conventional refuse containers at various angles. In addition, the end support members 106 may be designed to provide rigidity to the entire refuse container 10 when the protective liner insert 100 is completely installed and fixed to the conventional refuse container 10.

Referring now to FIG. 2, in the present embodiment, the protective liner insert 100 includes a first side wall support member 104*a* extending from the second side 102*b* of the base member 102, a second side wall support member 104*b* extending from the third side 102*c* of the base member 102, and a third side wall support member 104*c* extending from the fourth side 102*d* of the base member 102.

Figure 6:
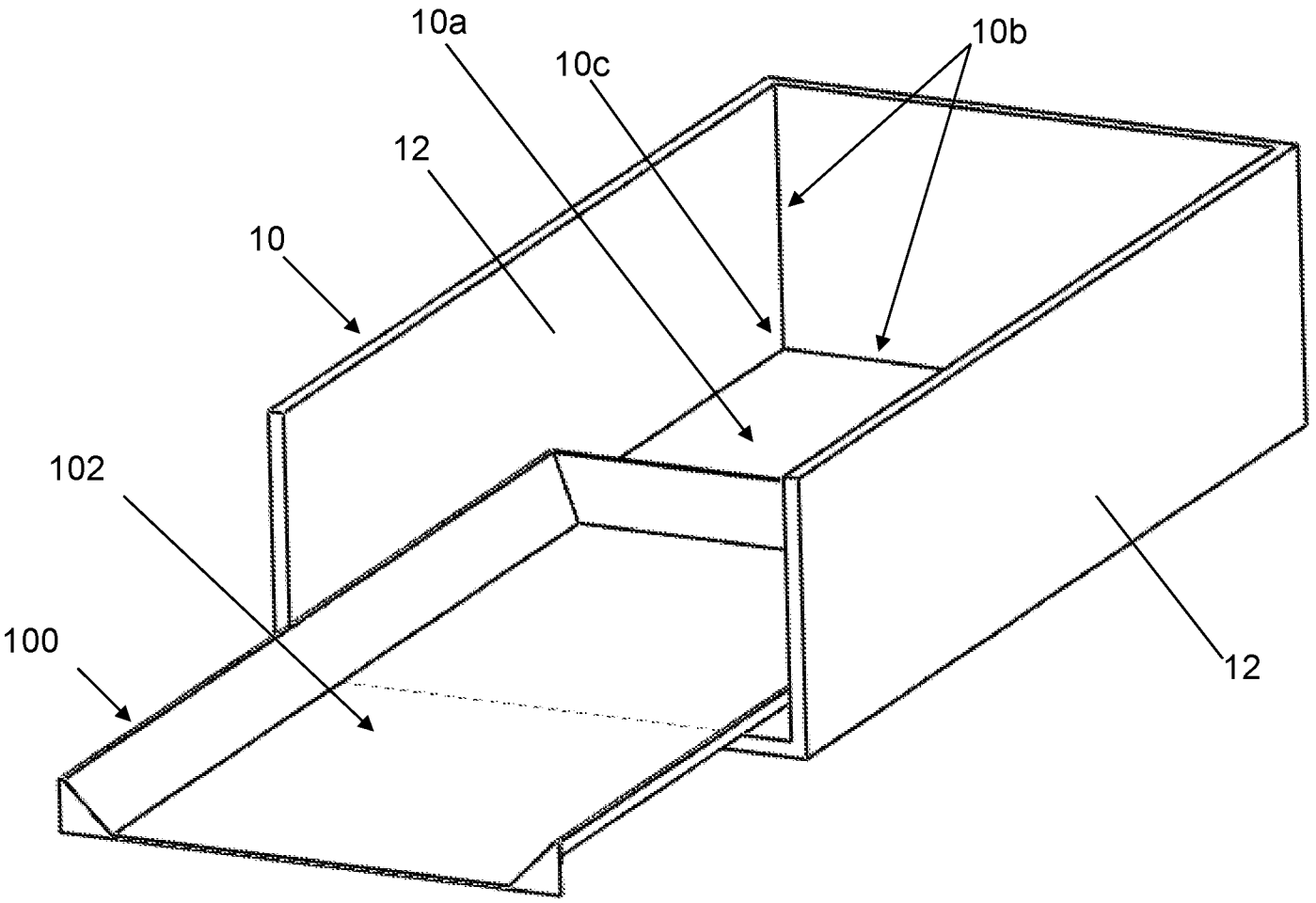
FIG. 6 is a front perspective assembly view the protective liner insert illustrated in FIG. 1, partially installed onto a conventional refuse container.

Referring to FIG. 6, a conventional refuse container 10 includes a plurality of walls 12 which extend from the flooring 10*a* to thereby form a container in which refuse or garbage may be stored. These refuse containers 10 include inner edges 10*b* and inner corners 10*c* which are formed in between the flooring 10*a* and the plurality of walls 12. The protective liner insert 100 according to present general inventive concept is designed and/or configured to protect the flooring 10*a*, inner edges 10*b*, and corners 10*c* of the refuse container 10 from damage. That is, the protective liner insert 100 is designed to completely cover the flooring 10*a*, the inner edges 10*b*, and the corners 10*c* of the refuse container 10 in order to shield and protect the flooring 10*a*, inner edges 10*b* and corners 10*c* from impact from objects being thrown into the refuse container 10.

Referring to FIG. 3, in the present embodiment, the side wall support members 104*a*, 104*b*, and 104*c* are each angled (i.e., predetermined angle A1) with respect to a top surface S1 (i.e., a first surface) of the planar base member 102 in order to deflect impact points away from the flooring 10*a*, inner edges 10*b* and corners 10*c* of the refuse container 10.

That is, since the inner edges 10*b* and corners 10*c* of the refuse container 10 experience greater amounts of impact and therefore greater damage, the side wall support members 104*a*, 104*b*, and 104*c* of the protective liner insert 100 are used to shield, deflect, and protect and deflect the flooring 10*a*, the inner edges 10*b*, and/or corners 10*c* from damage caused by items thrown into the refuse container 10.

In particular, the side wall support members 104 are specifically designed to be inclined at a predetermined angle A1 from the first surface S1 of the base member 102 in order to efficiently and/or effectively deflect an impact from an item being thrown into the refuse container 10 away from the flooring 10*a*, inner edges 10*b*, and corners 10*c* of the refuse container 10.

In addition, the predetermined angle A1 between the sidewall support support members 104*a*, 104*b*, and 104*c* and the base member 102 maximizes an amount of strength and rigidity the protective liner insert 100 provides when coupled and fixed to the refuse container 10.

Figure 4:
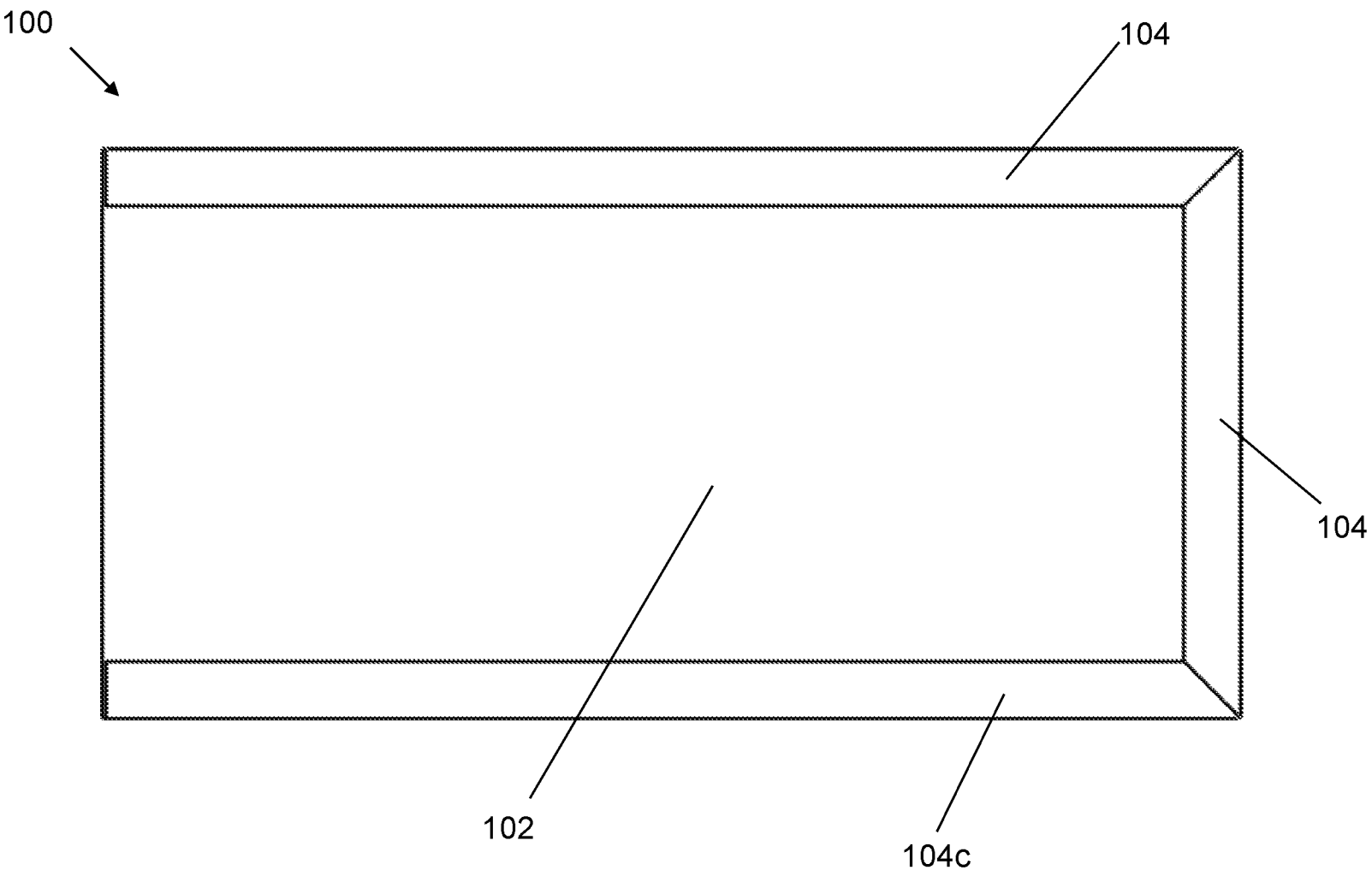
FIG. 4 is a bottom plan view of the protective liner insert illustrated in FIG. 1.
Figure 5:
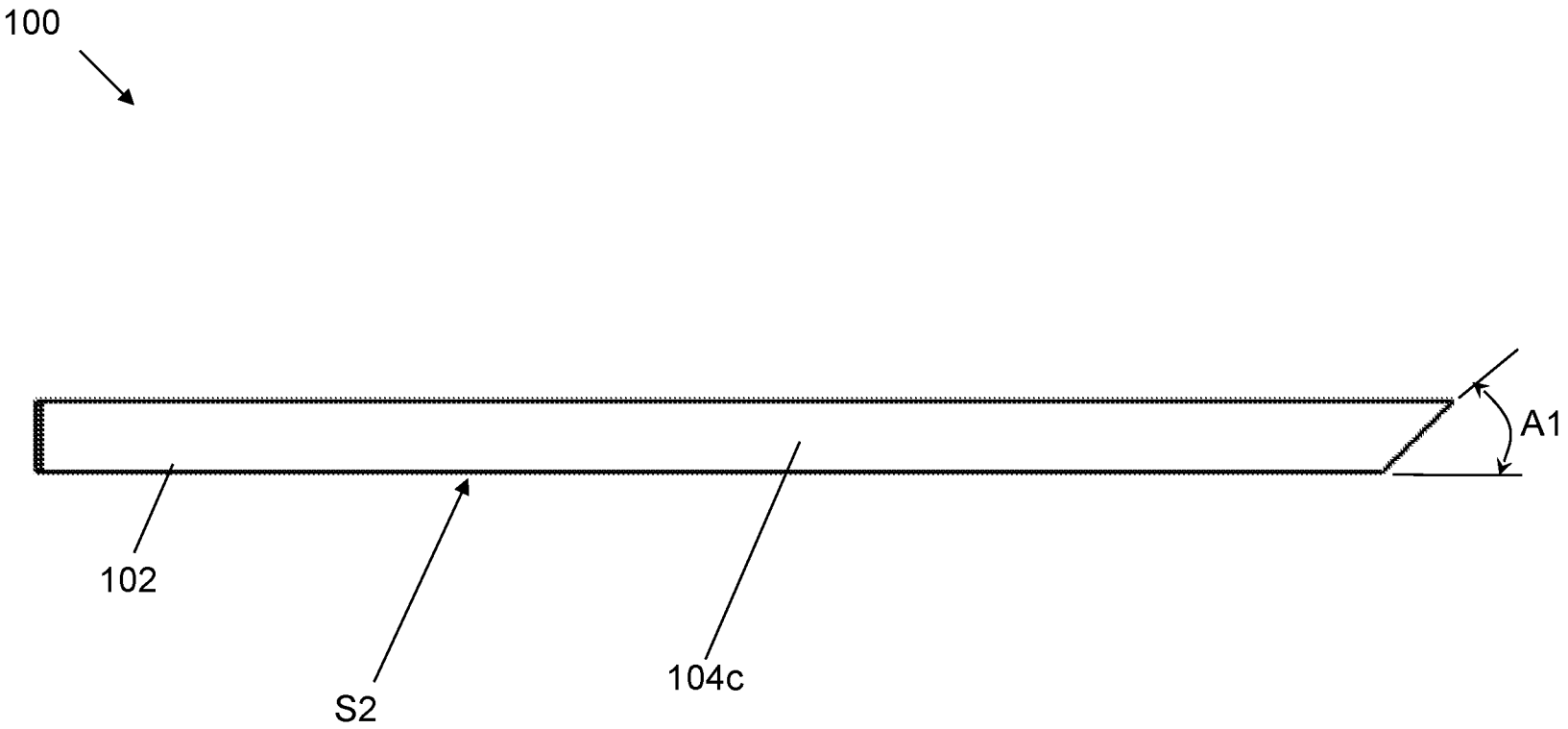
FIG. 5 is a side view of the protective liner insert illustrated in FIG. 1.

FIG. 4 is a bottom plan view of the protective liner insert 100 illustrated in FIG. 1. FIG. 5 is a side view of the protective liner insert 100 illustrated in FIG. 1.

In the present example embodiment, edges of the protective liner insert 100 may be coupled to the refuse container 10 by various mechanical fastening means including nuts and bolts, welding or the like. However, the present general inventive concept is not limited thereto. That is, in alternative example embodiments, the protective liner insert 100 may be coupled to the refuse container 10 by various conventionally known methods such as friction fit or various types of chemical fasteners or adhesives.

In the present embodiment, the predetermined angle A1 between the side wall support members 104*a*, 104*b*, and 104*c* and the top surface S1 (i.e., a first surface) of the planar base member 102 may vary from between about 10 degrees to about 70 degrees in order to effectively protect and deflect the inner edges 10*b* and/or corners 10*c* of the refuse container 10 from damage.

In an example embodiment, the predetermined angle A1 is about 45 degrees in order to deflect the inner edges 10*b* and corners 10*c* from impact and also to provide additional strength and rigidity to the refuse container 10. However, the present general inventive concept is not limited thereto.

Figure 7:
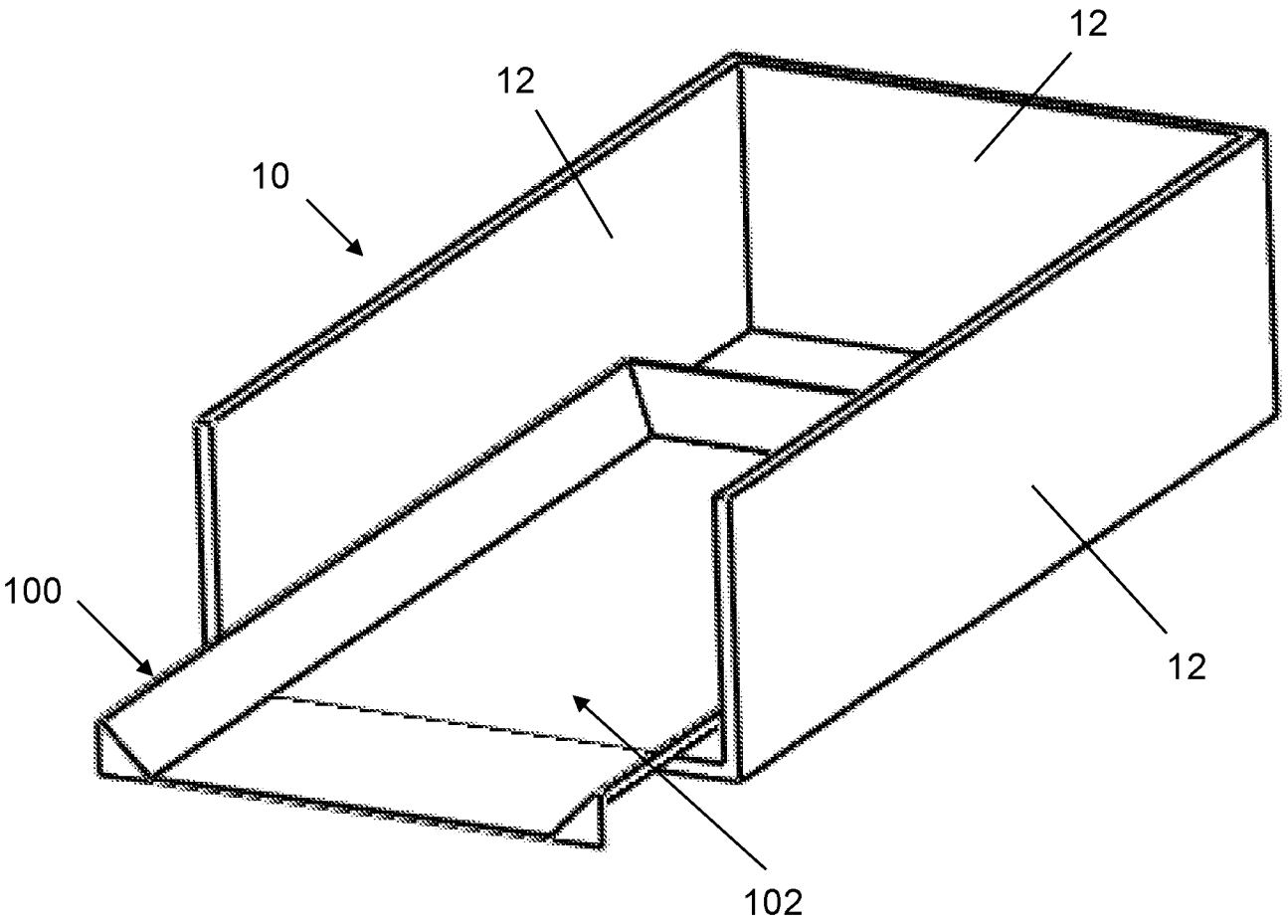
FIG. 7 is a front perspective assembly view of the protective liner insert illustrated in FIG. 6, further installed onto the conventional refuse container.
Figure 8:
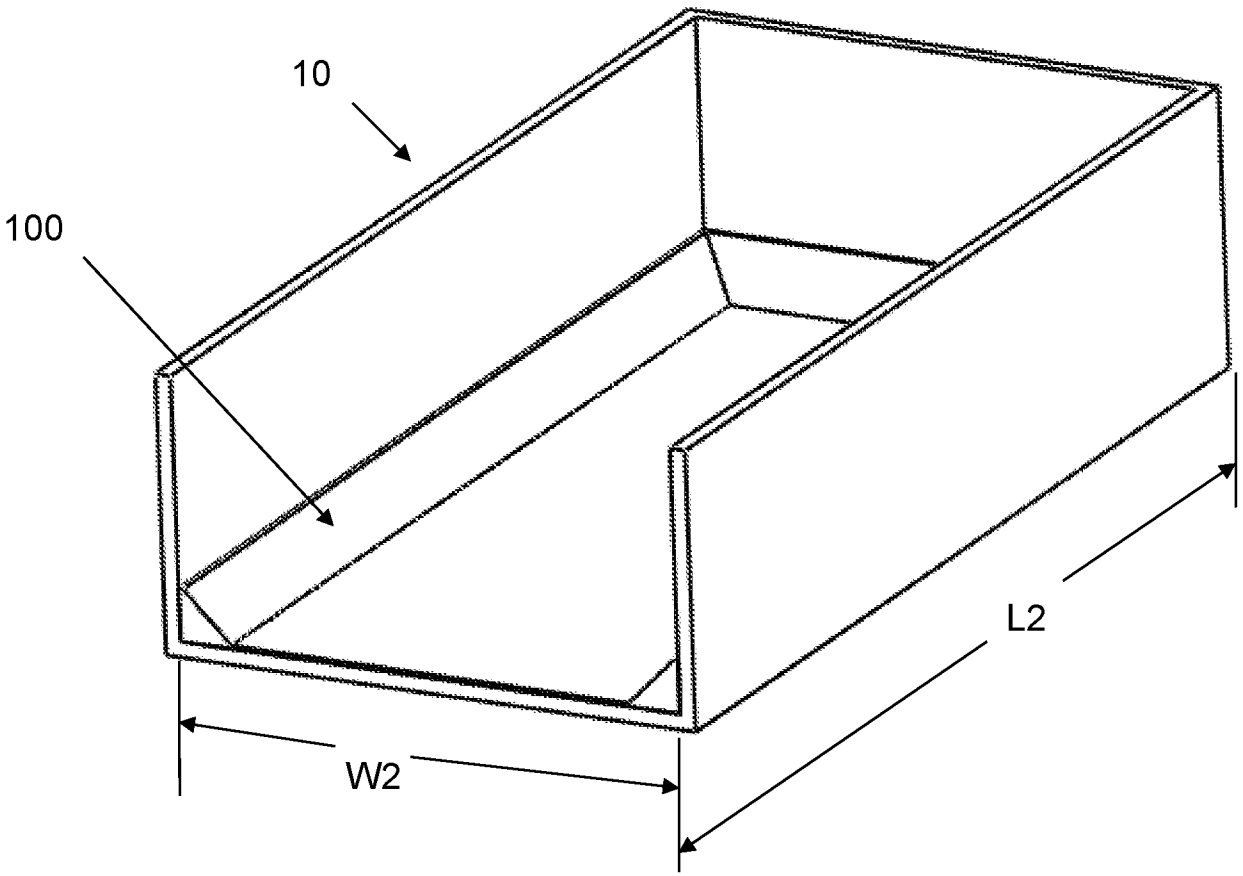
FIG. 8 is a front perspective assembly view the protective liner insert illustrated in FIG. 6, completely installed onto the conventional refuse container.

FIG. 6 is a perspective view the protective liner insert 100 illustrated in FIG. 1 partially installed onto a conventional refuse container 10. FIG. 7 is a perspective view of the protective liner insert 100 illustrated in FIG. 6, partially installed onto the conventional refuse container 10. FIG. 8 is a perspective view the protective liner insert 100 illustrated in FIG. 6, completely installed onto the conventional refuse container 14.

Referring to FIGS. 6 through 8, a method of installing a protective liner insert 100 according to the present general inventive concept onto a conventional refuse container 10 is illustrated. Initially, a protective liner insert 100 may be constructed and/or fabricated to have a length L1 and width W1 that corresponds to a length L2 and a width W2 of the refuse container 10.

In the present embodiment, the refuse container liner insert 100 may be constructed or manufactured to a length and width that corresponds to a length and width of a desired refuse container 10. The protective liner insert 100 may then be installed into the conventional refuse container 10.

Next, the protective liner insert 100 is aligned with an opening of the refuse container 10 and pushed until the first side wall support member 104*a* contacts the back wall 12 of the refuse container 10. Next, a mechanical fastening means may be used to secure the protective liner insert 100 onto the refuse container 10.

Referring to FIG. 8, the planar base member 102 covers the entire inner flooring 10*a* of the refuse container 10, thereby protecting the flooring 10*a*, inner edges 10*b*, and corners 10*c* from further damage. The side wall support members 104 extend in an inclined direction (e.g., angle A1) away from the planar base member 102 in order to deflect away a force or impact that may be headed toward the inner edges 10*b* or corners 10*c* of the refuse container 10, thereby preventing further damage to the refuse container 10.

According to the present embodiment, the protective liner 100 is installed onto the conventional refuse container 10 so that the bottom surface S2 of the base member 102 faces and contacts the flooring 10*a* of the refuse container 10. As illustrated in FIGS. 6-8, the angled sidewall support support members 104 cover and shield the entire flooring 10*a* and all of the inner edges 10*b* and corners 10*c* of the refuse container 10 from damage that may occur when items are thrown into the refuse container 10.

In the present embodiment, the pair of end support members 10*a*, 10*b* and the edges of the angled side wall support members 104 which are in contact with the conventional refuse container 10 may be permanently fixed to the refuse container 10 by using mechanical fastening means, such as a welding process. However, the present general inventive concept is not limited thereto. That is, in alternative example embodiments, the protective liner insert 100 may be attached and/or fixed to the refuse container 10 by using various other conventionally known fastening methods. In alternative embodiments, the refuse container liner insert apparatus 100 may be fabricated on site within a conventional refuse containers 10.

Figure 9:
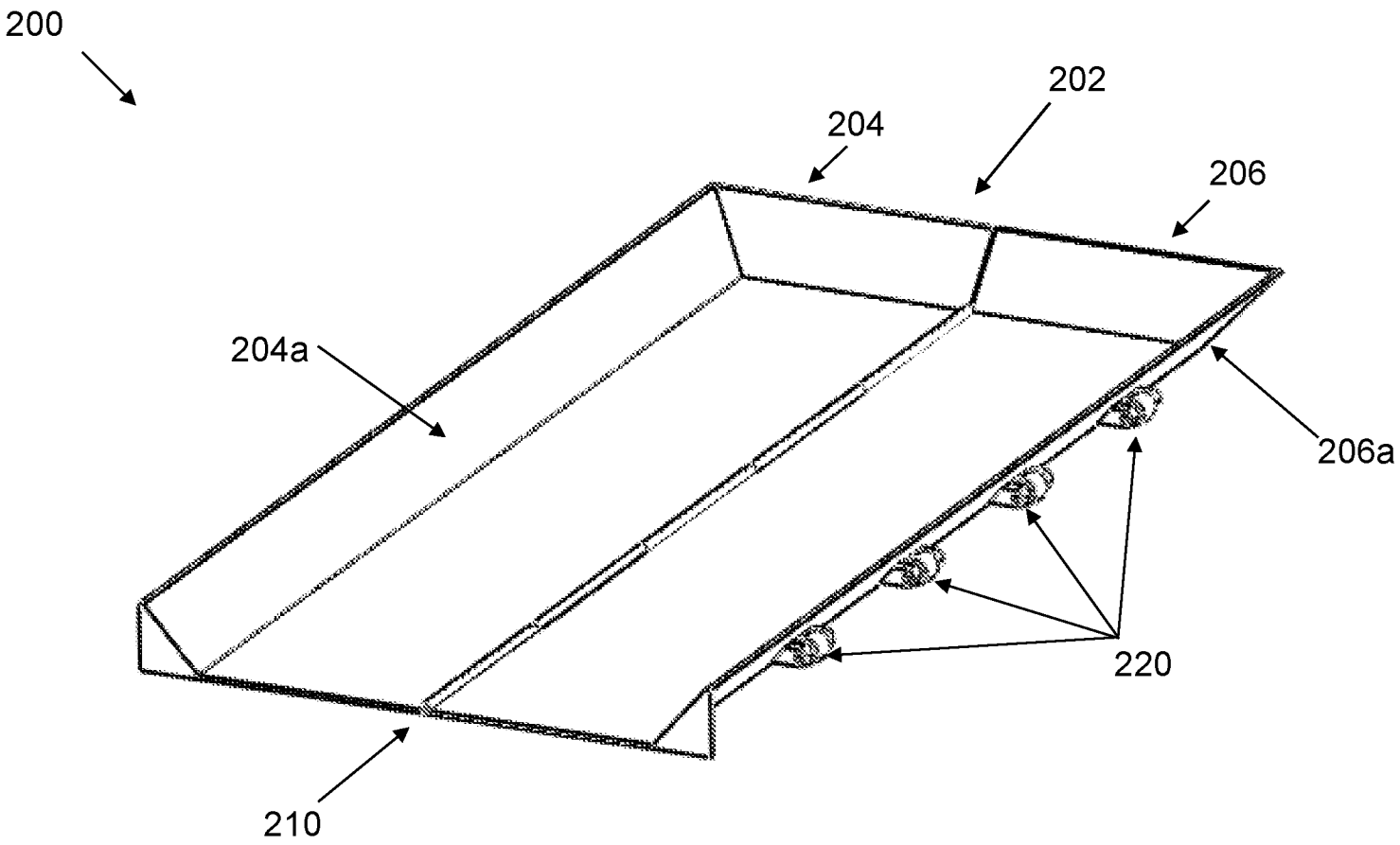
FIG. 9 is a front perspective view of a refuse container protective liner insert according to an another example embodiment of the present general inventive concept, in an unfolded state.
Figure 10:
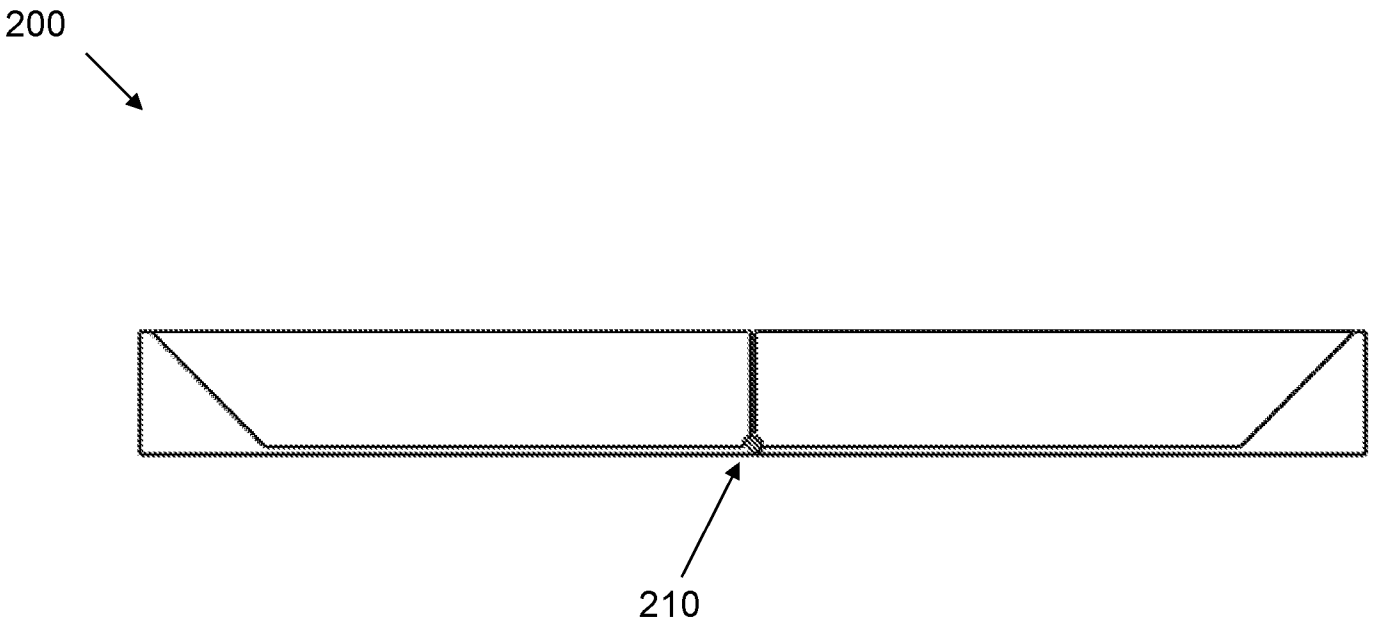
FIG. 10 is a front view of the protective liner insert illustrated in FIG. 9.

FIG. 9 is a front perspective view of a refuse container protective liner insert 200 according to another example embodiment of the present general inventive concept, in an unfolded state. FIG. 10 is a front view of the protective liner insert 200 illustrated in FIG. 9 and FIG. 11 is a perspective view of the protective liner insert 200 illustrated in FIG. 9, in a partially folded state.

Figure 11:
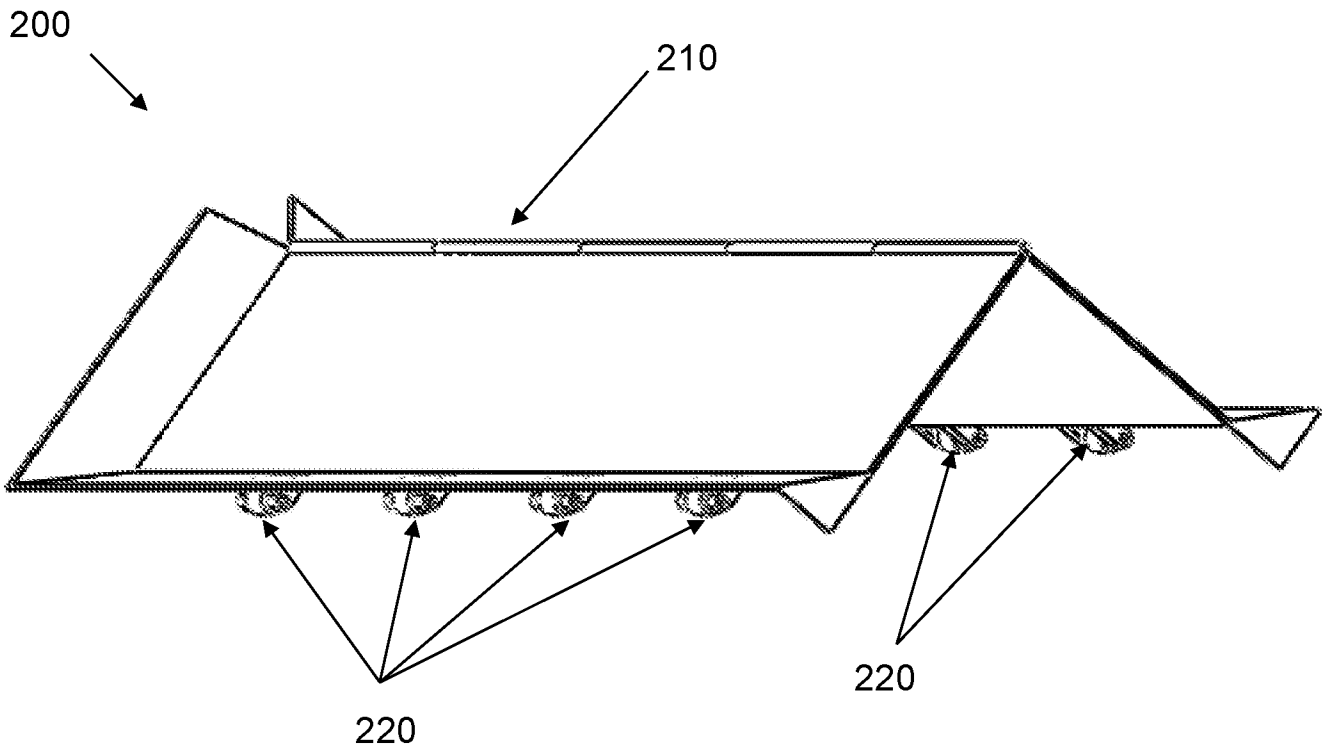
FIG. 11 is a perspective view of the protective liner insert illustrated in FIG. 9, in a partially folded state.
Figure 12:
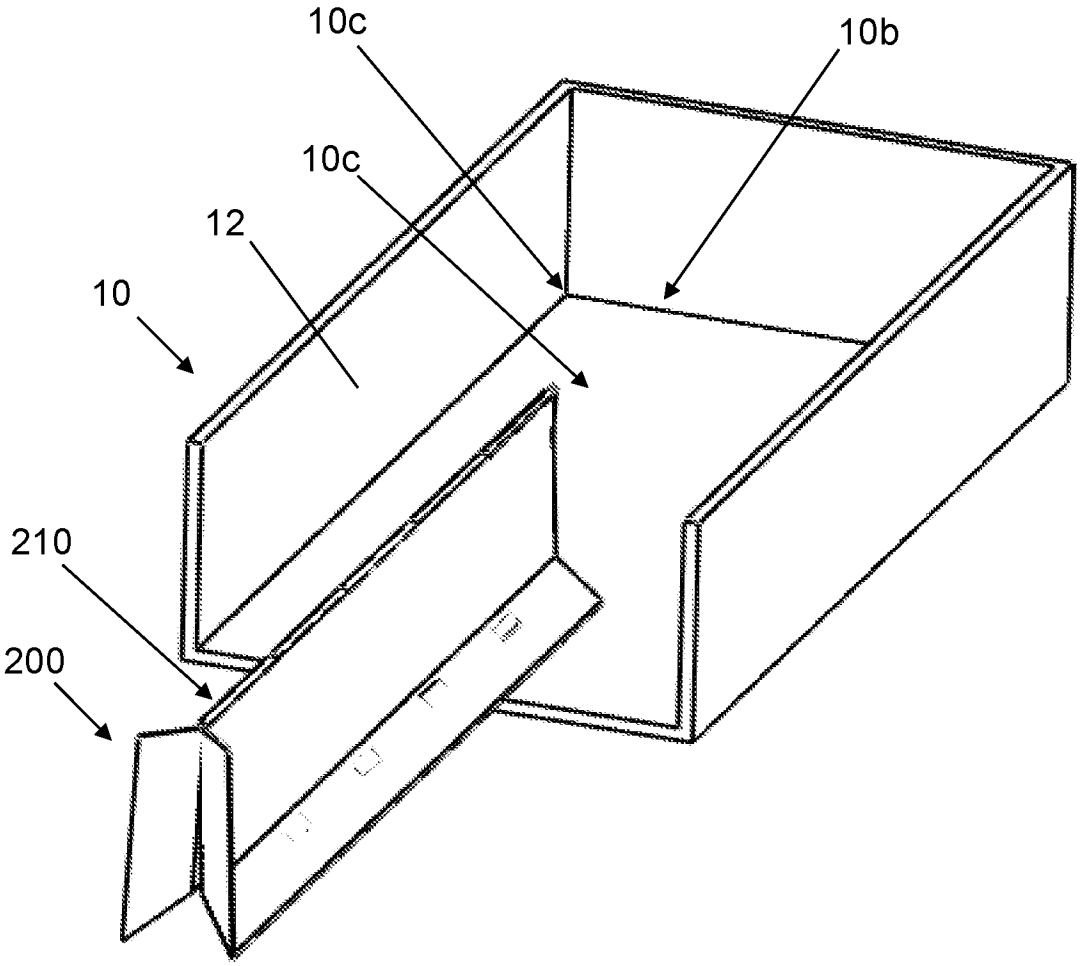
FIG. 12 is a front perspective assembly view of the protective liner insert illustrated in FIG. 11 in a completely folded state, partially installed onto a conventional refuse container.
Figure 13:
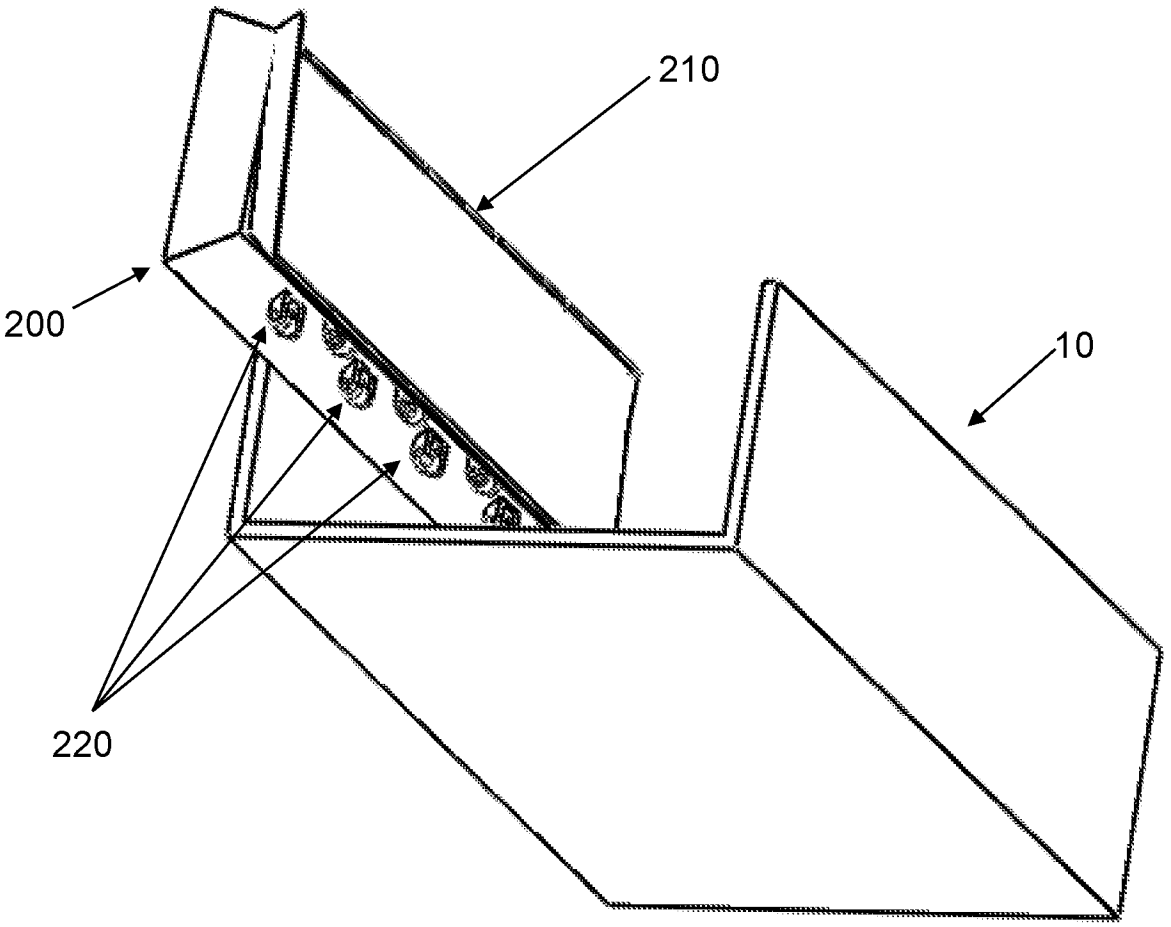
FIG. 13 is a bottom perspective assembly view the protective liner insert illustrated in FIG. 12.
Figure 14:
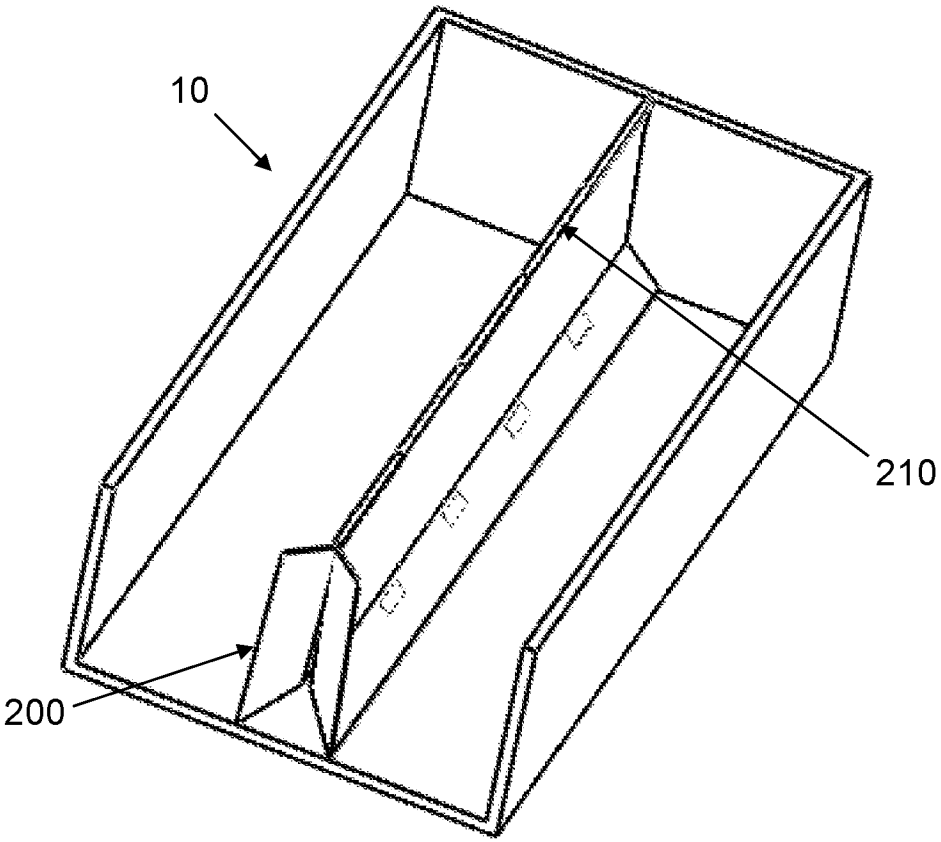
FIG. 14 is a front perspective assembly view of the protective liner insert illustrated in FIG. 12, further installed onto the conventional refuse container.
Figure 15:
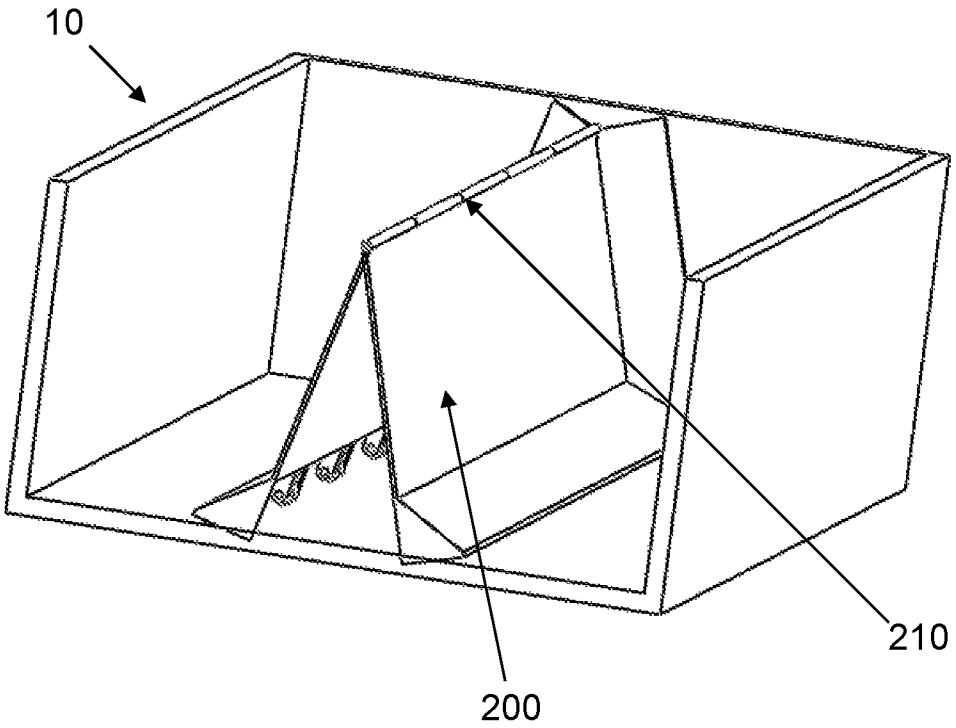
FIG. 15 is a front perspective assembly view of the protective liner insert illustrated in FIG. 14, in a partially unfolded state.
Figure 16:
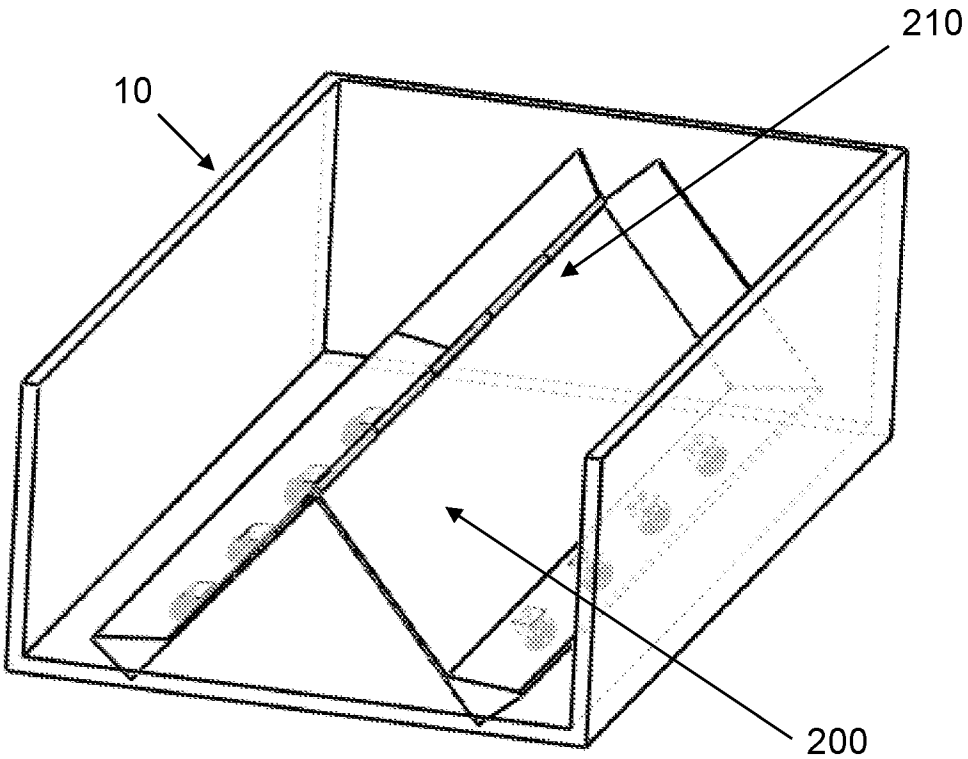
FIG. 16 is a front perspective assembly view of the protective liner insert illustrated in FIG. 15, in a further unfolded state.
Figure 17:
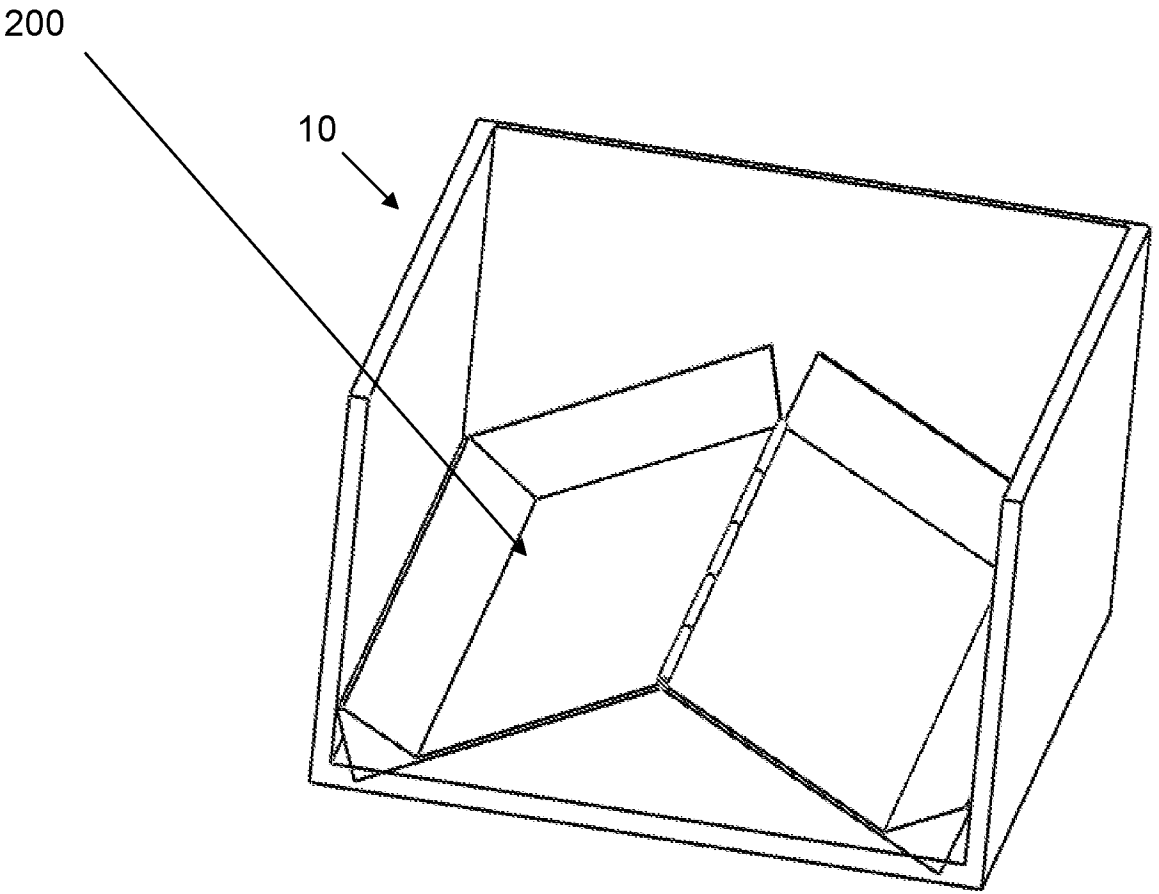
FIG. 17 is a front perspective assembly view of the protective liner insert illustrated in FIG. 16, in a yet further unfolded state.
Figure 18:
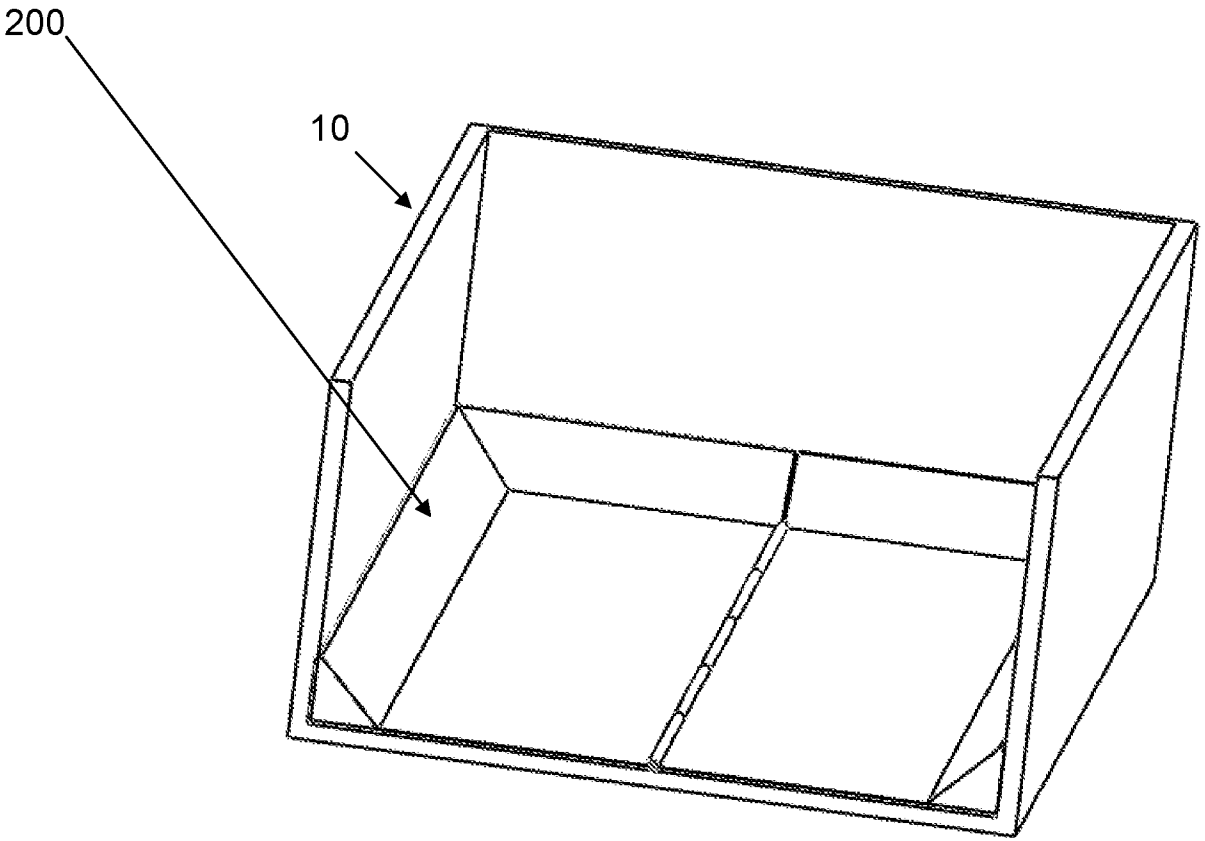
FIG. 18 is a front perspective assembly view the protective liner insert illustrated in FIG. 18, completely unfolded and installed onto the conventional refuse container.

Referring to FIGS. 9 through 11, the refuse container liner insert 200 according to the present general inventive concept is substantially similar to the embodiment illustrated in FIG. 1, but further includes a hinge member 210 and a plurality of wheels 220 to allow the protective liner insert 200 to be foldable between a first state (i.e., closed) and a second state (i.e., opened) for easy storage, transport, and installation on to a refuse container 10.

Referring now to FIG. 9, the refuse container protective liner insert 200 according to the present example embodiment includes a foldable base member 202 having a first side wall support member 204 and a second side wall support member 206 coupled to opposite sides of the hinge member 210. The first side wall support member 204 includes an angled side wall support portion 204*a* to protect the inner flooring, sidewalls, and corners of the refuse container 10. Similarly, the second side wall support member 206 includes an angled side wall support portion 206*a* to protect the inner flooring, sidewalls, and corners of the refuse container 10. In the present exemplary embodiment, the hinge member 210 allows the first side wall support member 206 to fold with respect the second side wall support member 204 to allow the protective liner insert to be easily stored, transported, and installed onto a conventional refuse container 10.

As described herein, a conventional refuse container 10 typically includes a plurality of walls 12 which extend from the flooring 10*a* to thereby form a container in which refuse or garbage may be stored. These refuse containers 10 include inner edges 10*b* and inner corners 10*c* which are formed in between the flooring 10*a* and the plurality of walls 12.

The protective liner insert 200 according to present general inventive concept is designed and/or configured to protect the flooring 10*a*, inner edges 10*b*, and corners 10*c* of the refuse container 10 from damage. That is, the protective liner insert 200 is designed to include angled side wall support portions 204*a*, 206*a* which completely cover the flooring 10*a*, the inner edges 10*b*, and the corners 10*c* of the refuse container 10 in order to shield, deflect, and protect the flooring 10*a*, inner edges 10*b* and corners 10*c* from impact from objects being thrown into the refuse container 10. The angled side wall support portions 204*a*, 206*a* are substantially similar to the sidewall support members 104 described in previous embodiments but are cut in half to allow the first side wall support member 206 to fold with respect the second side wall support member 204.

The protective liner insert 200 according to present general inventive concept is designed with the hinge member 210 to allow the first side wall support member 204 and the second side wall support member 206 move between the first position (i.e., closed state) and the second position (i.e., opened state). That is, the hinge member 210 allows the first side wall support member 204 to fold with respect to the second side wall support member 206 to provide for easier storage, transport, and installation of the protective liner insert 200 onto a conventional refuse container 10.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A foldable protective liner insert apparatus combined with a refuse container, the foldable apparatus comprising:
- a refuse container;
- a pair of planar base members each having a first surface, an opposing second surface coupled to the refuse container, and a plurality of sides;
- a hinge member coupled between each planar base members;
- a first side wall support member extending from a first side of the base member;
- a second side wall support member extending from a second side of the base member;
- a third side wall support member extending from a third side of the base member;
- a plurality of wheels attached to the planar base member to allow for easy transport,
- wherein the side wall support members are each angled with respect to the base member to protect inner corners and edges of the refuse container from impact.

2. The insert apparatus of claim 1, wherein the planar base member has a thickness of between 0.125 to 1.00 inches.

3. The insert apparatus of claim 1, further comprising a hinge member disposed along a center of the planar base member to allow the base member to fold between a first state and a second state, for easy storage.

4. A foldable protective liner insert apparatus combined with a refuse container, the foldable apparatus comprising:
- a refuse container;
- a foldable base member having a first sidewall support member and a second sidewall support member having a surface coupled to the refuse container;
- a hinge member coupled between the first and second sidewall support members to allow the foldable base member fold between a first open state and a second closed state; and
- a plurality of wheels coupled to an outer surface of the first and second sidewall support members,
- wherein the first and second sidewall support members each include angled side wall support portions used to deflect impact away from inner surfaces of the refuse container.

5. The foldable protective liner insert apparatus of claim 4, wherein the angled side wall support portions form an angle between 10 degrees to about 60 degrees with the foldable base member.

* * * * *